US010461432B1

(12) United States Patent
Walker

(10) Patent No.: US 10,461,432 B1
(45) Date of Patent: Oct. 29, 2019

(54) COLLAPSIBLE FEED STRUCTURES FOR REFLECTOR ANTENNAS

(71) Applicant: Arizona Board of Regents on Behalf of the University of Arizona, Tucson, AZ (US)

(72) Inventor: Christopher K. Walker, Tucson, AZ (US)

(73) Assignee: Arizona Board of Regents on Behalf of the University of Arizona, Tucson, AZ (US)

( * ) Notice: Subject to any disclaimer, the term of this patent is extended or adjusted under 35 U.S.C. 154(b) by 0 days.

(21) Appl. No.: 15/667,226

(22) Filed: Aug. 2, 2017

Related U.S. Application Data

(60) Provisional application No. 62/369,994, filed on Aug. 2, 2016.

(51) Int. Cl.

| | |
|---|---|
| ***H01Q 9/40*** | (2006.01) |
| ***H01Q 1/08*** | (2006.01) |
| ***H01Q 1/28*** | (2006.01) |
| ***H01Q 15/16*** | (2006.01) |

(52) U.S. Cl.
CPC ..... *H01Q 9/40* (2013.01); *H01Q 1/082* (2013.01); *H01Q 1/288* (2013.01); *H01Q 15/163* (2013.01)

(58) Field of Classification Search
CPC ..... H01Q 9/40; H01Q 15/163; H01Q 1/082; H01Q 1/288
USPC ..... 343/706
See application file for complete search history.

(56) References Cited

U.S. PATENT DOCUMENTS

| | | | | |
|---|---|---|---|---|
| 4,516,128 | A * | 5/1985 | Watanabe | H01Q 3/20 343/761 |
| 6,229,495 | B1 * | 5/2001 | Lopez | H01Q 9/32 343/702 |
| 7,692,598 | B1 * | 4/2010 | Hibbard | H01Q 9/44 343/700 MS |
| 9,793,612 | B1 * | 10/2017 | Siripuram | H01Q 11/08 |
| 2005/0275590 | A1 * | 12/2005 | Eom | H01Q 1/22 343/700 MS |
| 2007/0040758 | A1 * | 2/2007 | Dwyer | H01Q 1/38 343/792 |
| 2008/0224931 | A1 * | 9/2008 | Weiss | H01Q 1/38 343/700 MS |
| 2009/0005766 | A1 * | 1/2009 | Brannan | A61B 18/18 606/10 |

(Continued)

FOREIGN PATENT DOCUMENTS

RU 132922 U1 * 9/2013

*Primary Examiner* — Lam T Mai
(74) *Attorney, Agent, or Firm* — Blank Rome LLP

(57) ABSTRACT

Collapsible feed structures to further improve the ability of a reflector antenna (e.g., a spherical balloon reflector antenna) to collapse are disclosed. In a first embodiment, feed systems that include a metallic layer deposited on a dielectric support curtain (e.g., the dielectric support curtain of a spherical balloon antenna), one or more Vee antenna structures, patterned on the metallic layer, that receive a signal reflected off a reflective surface and/or emit a signal that is reflected off a reflective surface, and one or more slot line transmission lines, patterned on the metallic layer, that transmit a signal to and/or from one of the Vee antenna structures. In a second embodiment, a collapsible line feed that includes a plurality of metallic disks and a flexible monopole passing through the plurality of metallic disks.

12 Claims, 5 Drawing Sheets

(56) References Cited

U.S. PATENT DOCUMENTS

| | | | | |
|---|---|---|---|---|
| 2010/0109964 | A1* | 5/2010 | Eom | H01Q 15/04 343/793 |
| 2013/0044038 | A1* | 2/2013 | Packer | H01Q 1/242 343/822 |
| 2018/0123255 | A1* | 5/2018 | Hendry | H01Q 1/36 |

* cited by examiner

COLLAPSIBLE FEED STRUCTURES FOR REFLECTOR ANTENNAS

CROSS REFERENCE TO RELATED APPLICATIONS

This application claims priority to U.S. Prov. Pat. No. 62/369,994, filed Aug. 2, 2016, the entire contents of which is hereby incorporated by reference.

STATEMENT REGARDING FEDERALLY SPONSORED RESEARCH

Not applicable.

BACKGROUND

Conventional high gain space antennas are expensive to transport into space and place in orbit because of their size, weight, and inability to collapse in three dimensions. In order to overcome these and other disadvantages of the prior art, PCT Pat. Appl. No. PCT/US16/42462, filed Jul. 15, 2016, and U.S. patent application Ser. No. 15/154,760, filed May 13, 2016, disclose a balloon reflector antenna with an inflatable balloon. The contents of each of those applications are hereby incorporated by reference.

FIG. 1 is a diagram illustrating a satellite 100 with a large balloon reflector antenna 120 as deployed (e.g., in space) according to PCT Pat. Appl. No. PCT/US16/42462 and U.S. patent application Ser. No. 15/154,760.

As shown in FIG. 1, the balloon reflector antenna 120 includes a spherical balloon 140, which includes a surface transparent to electromagnetic waves 142 and a reflective surface 144 opposite the transparent surface 142. (The balloon 140 may also include one or more dielectric support curtains 146 across a diameter of the balloon 140 to help the balloon 140 keep its spherical shape.) The balloon reflector antenna 120 includes a feed system 160, which may be one or more feedhorns, planar antennas, spherical correctors such as a quasi-optical spherical corrector or a line feed (as illustrated in FIG. 1), or any other suitable device that receives electromagnetic waves that are reflected off the reflective surface 144 or emits electromagnetic waves that are reflected off the reflective surface 144.

When the balloon reflector antenna 120 receives a signal (e.g., from the ground), the signal passes through the transparent surface 142 and encounters the reflective surface 144, which focuses the signal into the feed system 160. When the balloon reflector antenna 120 transmits a signal (e.g., to the ground), the signal is emitted by the feed system 160 and encounters the reflective surface 144, which directs the signal through the transparent surface 142. Ideally, the feed system 160 provides a high gain and an antenna beam that is easily steered through large angles without degradation.

As shown in FIG. 1, a spherical reflective surface, such as the reflective surface 144, focuses parallel rays to a line (as opposed to a parabolic reflective surface, which focuses parallel rays to a point). The simplest "corrector" for this spherical aberration is a line feed, such as a pivoting line feed as described in U.S. patent application Ser. No. 15/154,760 or a phased array line feed as described in PCT Pat. Appl. No. PCT/US16/42462.

The satellite 100 also includes a balloon reflector canister 182, a radio frequency (RF) module 184, a telecommunications module 186, a pitch reaction wheel 188, a roll reaction wheel 189, a power module 190, and solar cells 192.

In addition to providing a high gain antenna and steerable beam at a significantly reduced weight, the spherical balloon 140 overcomes disadvantages of the prior art by collapsing in three dimensions in order to be stowed for launch.

FIG. 2 is a diagram illustrating the satellite 100 with the spherical balloon 140 and the feed system 160 stowed for launch in the balloon reflector canister 182. In some embodiments, a small (e.g., 1-2 meter) spherical balloon 140 can collapse so effectively as to stow in a single 1U CubeSat unit. In another embodiment, even a large (e.g., 10 meter) spherical balloon 140 and associated RF payload can easily fit into existing rocket fairings.

Because the feed system 160 must also be stowed for launch (for example, in one or more 1U CubeSat units), there is a need for collapsible feed systems.

SUMMARY

In order to further improve the ability of a reflector antenna (e.g., a spherical balloon reflector antenna) to collapse, collapsible feed structures are provided.

In a first embodiment, there are provided feed systems that include a metallic layer deposited on a dielectric support curtain (e.g., the dielectric support curtain of a spherical balloon antenna), one or more Vee antenna structures, patterned on the metallic layer, that receive a signal reflected off a reflective surface and/or emit a signal that is reflected off a reflective surface, and one or more slot line transmission lines, patterned on the metallic layer, that transmit a signal to and/or from one of the Vee antenna structures. For circularly polarized applications, a Vee antenna structure may include a planar Vee antenna structure and an orthogonal Vee antenna structure.

In a second embodiment, there is provided a collapsible line feed that includes a plurality of metallic disks and a flexible monopole passing through the plurality of metallic disks.

BRIEF DESCRIPTION OF THE DRAWINGS

Aspects of exemplary embodiments may be better understood with reference to the accompanying drawings. The components in the drawings are not necessarily to scale, emphasis instead being placed upon illustrating the principles of exemplary embodiments, wherein.

DETAILED DESCRIPTION

Figure 1:
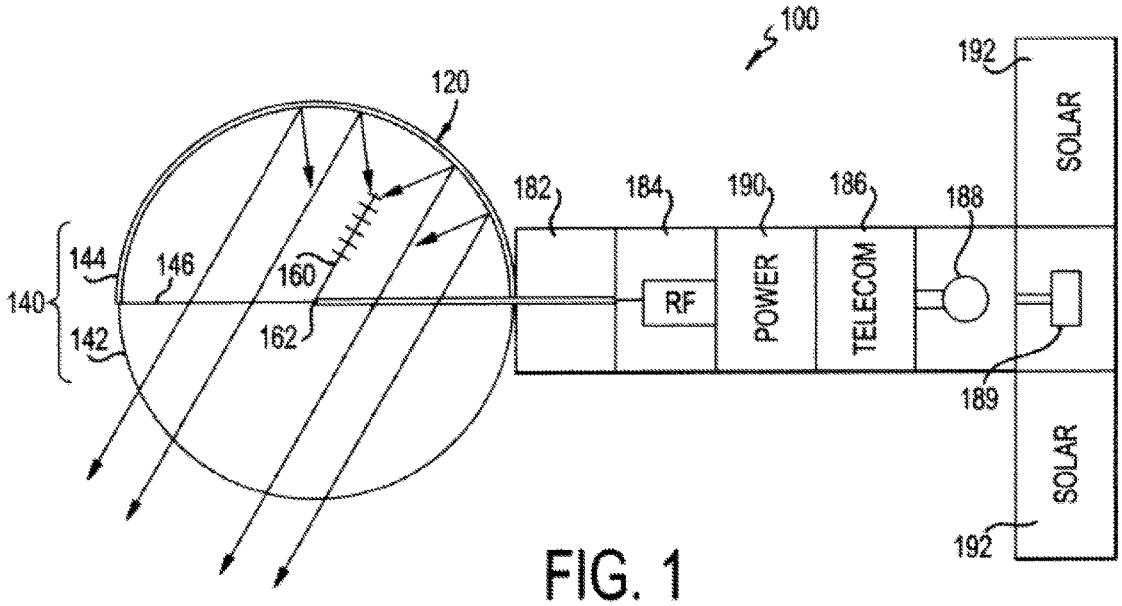
FIG. 1 (RELATED ART)
FIG. 1 is a diagram illustrating a related art satellite with a large balloon reflector antenna as deployed.

Preferred embodiments of the present invention will be set forth in detail with reference to the drawings, in which like reference numerals refer to like elements or steps throughout.

Figure 2:
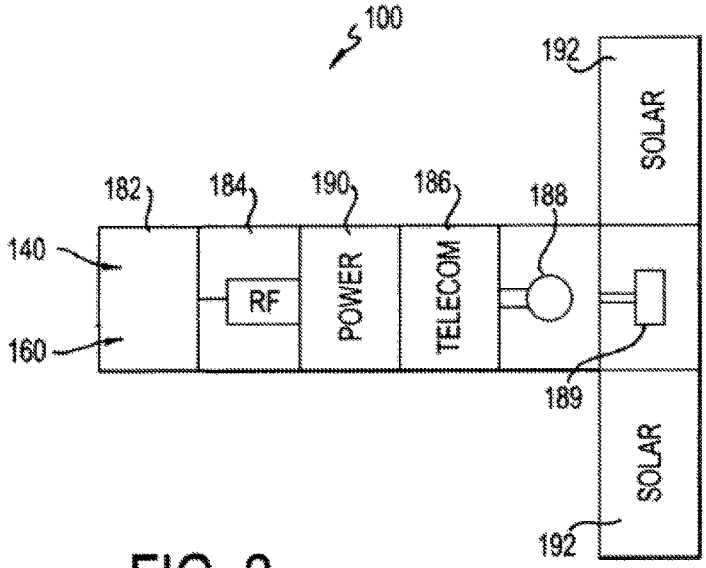
FIG. 2 (RELATED ART)
FIG. 2 is a diagram illustrating the related art satellite shown in FIG. 1 with the spherical balloon and the feed system stowed for launch.

As shown in FIGS. 1 and 2 and described above, a feed system is used to gather energy from and/or spread energy across a reflective surface. Feed systems are typically 3-dimensional, rigid structures. In order to further improve the ability of a reflector antenna (e.g., a spherical balloon reflector antenna) to collapse, collapsible feed devices are disclosed. Each of the exemplary embodiments are complementary, meaning they can be used separately (to reduce the weight and volume of the feed system) or in conjunction with each other to further increase the antenna gain, the angle of radiation, etc.

In order to clearly describe aspects of the exemplary embodiments of the present invention, the collapsible feed devices are described as they would be used in conjunction with the spherical balloon 140 of FIG. 1. As one of ordinary skill in the art would recognize, however, each of the collapsible feed devices disclosed herein may be used in conjunction with other reflector antennas, including rigid reflector antennas.

Figure 3:
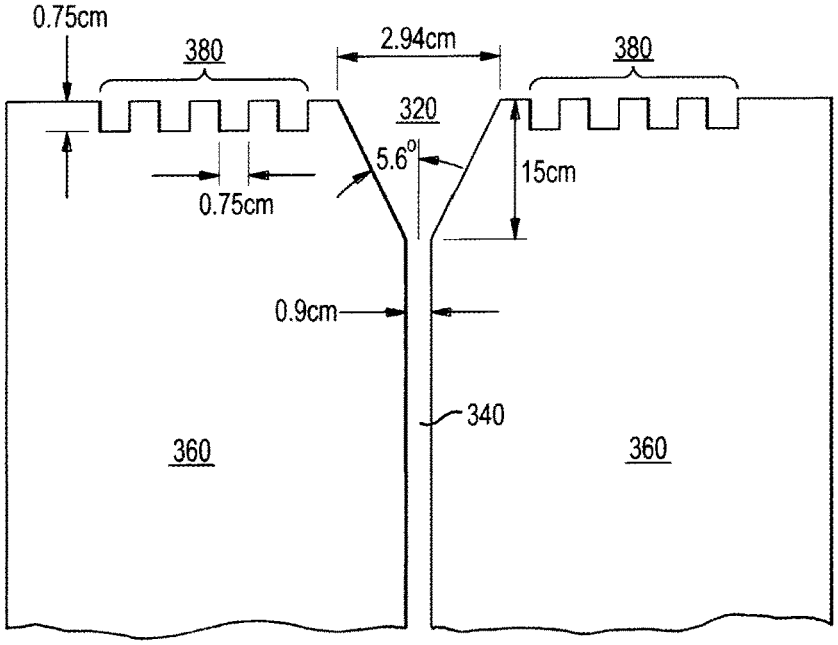
FIG. 3 is a diagram illustrating a feed system according to an exemplary embodiment of the present invention.

FIG. 3 is a diagram illustrating a feed system 300 having a wavelength of interest λ according to an exemplary embodiment of the present invention.

As shown in FIG. 3, the feed system 300 is formed by patterning a v-shaped antenna structure 320 and a slot transmission line 340 on a metallic layer 360 deposited on a dielectric support curtain (e.g., one of the dielectric support curtains 146 of FIG. 1) within a spherical reflector (e.g., the spherical balloon 140 of FIG. 1). To aid in side lobe suppression, a series of E4 steps 380 may be fabricated on both sides of the antenna structure 320 to form a radio frequency (RF) choke.

When the feed system 300 is used to receive a signal (e.g., from the ground), the signal is received by the antenna structure 320. For example, a signal passes through the transparent surface 142 and encounters the reflective surface 144, which focuses the signal into the antenna structure 320. When the feed system 300 is used to transmit a signal (e.g., to the ground), the signal is emitted by the antenna structure 320 and, for example, encounters the reflective surface 144, which directs the signal through the transparent surface 142. The slot transmission line 340 transmits the signals between the antenna structure 320 and the RF module 184 (not shown), for example via a coaxial cable.

For low loss, the thickness of the metallic layer 360 may be ≥3δ, where δ is the electromagnetic skin depth of the metal film at the wavelength of interest λ. The width of the slot transmission line 340 may be optimized for low loss at the wavelength of interest λ. The antenna structure 320 may be one or more λ long. The opening D of the antenna structure 320 may be 3 times the desired Gaussian beam waist $\omega_0$, which is determined by Equation 1.

$$\omega_0 = 0.22[T_E]^{\frac{1}{2}} f\#\lambda \qquad \text{Eq. 1}$$

where:

$T_E$ is the desired edge taper (in dB) for illuminating the reflector (usually ~14 dB);

f# is the f/d ratio of the reflector (usually ~0.6 for a spherical reflector); and λ is the wavelength of operation.

At 10 GHz (X-Band), the electromagnetic skin depth δ of copper is ≈0.7 In the example shown in FIG. 3, the wavelength of interest λ is 3 cm, the metallic layer 360 is copper, the thickness of the metallic layer 360 is ≥2.1 μm, the width of the slot transmission line 340 is 0.9 cm, the antenna structure is 15 cm long, the opening D of the antenna structure 320 is 2.94 cm, and the steps 380 have a height and width of 0.75 cm. The dielectric curtain 146 may be formed, for example, from 0.5 mil polyester film.

Figure 4:
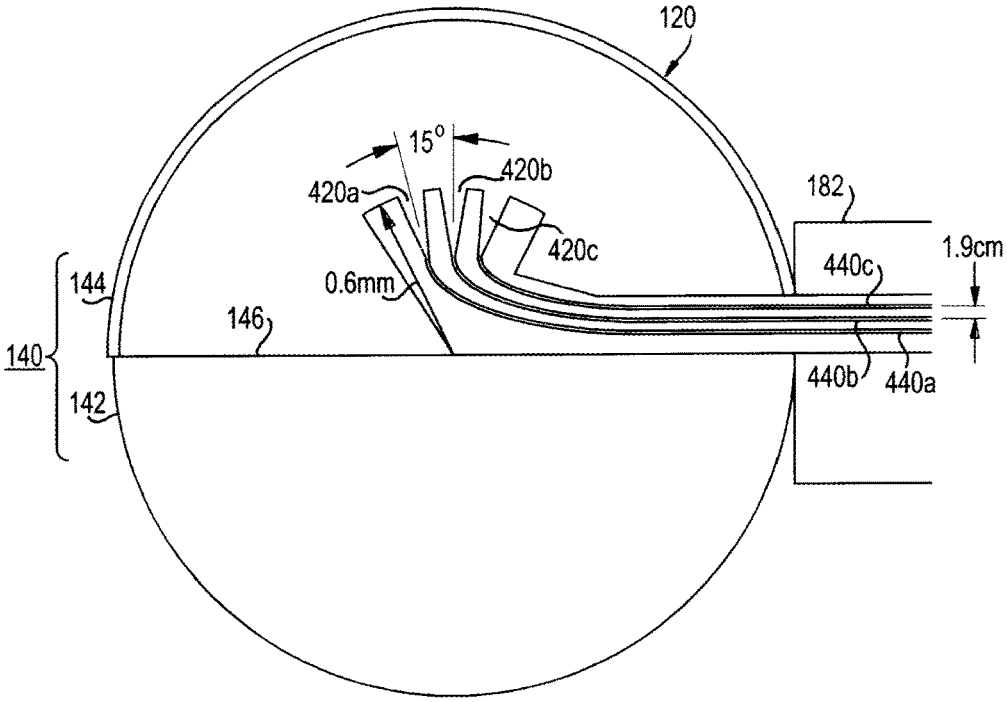
FIG. 4 is a diagram illustrating a feed system according to another exemplary embodiment of the present invention.

FIG. 4 is a diagram showing a feed system 400 according to an exemplary embodiment of the present invention.

As shown in FIG. 4, the feed system 400 includes multiple v-shaped antenna structures 460*a-c* (each with a slot transmission line 440*a-c*) patterned in an arc on the same dielectric support curtain 146 to produce an array of feeds. Similar to the feed system 400, the antenna structures 460*a-c* and the slot transmission lines 440*a-c* are patterned on a metallic layer 460 deposited on the dielectric support curtain 146. Each antenna structure 460*a-c* illuminates a spot on the spherical reflective surface 144, which in turn yields a power pattern through which electromagnetic waves can enter or leave the spherical reflector antenna 120. Each slot transmission line 440*a-c* transmits signals between a respective antenna structure 460*a-c* and the RF module 184 (not shown), for example via a coaxial cable.

While the feed system 300 may be used to send/receive signals to/from a single point (for example, for a satellite in geosynchronous orbit), the v-shaped antenna structures 460*a-c* may be arranged in an array (for example, to steer a beam of the reflector antenna 120). Any number of antenna structures 460*a-c* may be included in the feed system 400, depending on the needs of the particular application and the space constraints on the dielectric support curtain 146. The angular separation of the antenna structures 460 can be varied to match the requirements of a particular application. In the example shown in FIG. 4, the feed system 400 includes three antenna structures 460*a-c*, the angular separation between each of the antenna structures 460 is 15 degrees, the antenna structures 460*a-c* extend 0.6 m from the base, the thickness of the metallic layer 460 is ≈2.1 the slot transmission lines 440*a-c* are separated by 1.9 cm (center-to-center), and each of the antenna structures 460*a-c* illuminates ≈0.83 m of the reflective surface 144.

Figure 5A:
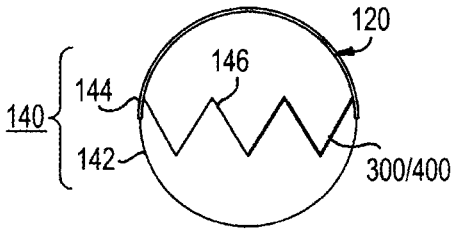
FIG. 5A is a diagram illustrating the feed system of FIG. 3 or FIG. 4 in a partially collapsed state according to exemplary embodiments of the present invention.
Figure 5B:
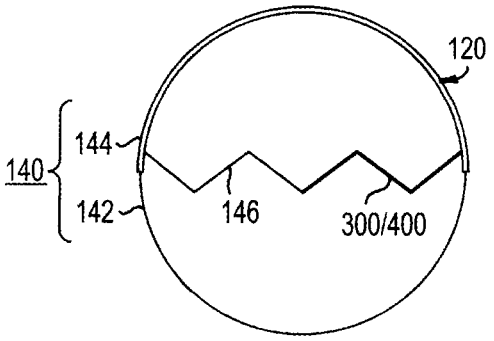
FIG. 5B is a diagram illustrating the feed system of FIG. 3 or FIG. 4 in another partially collapsed state according to exemplary embodiments of the present invention.
Figure 5C:
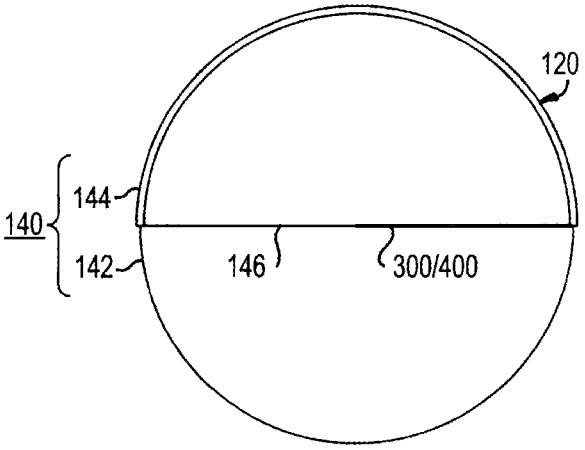
FIG. 5C is a diagram illustrating the feed system of FIG. 3 or FIG. 4 in an extended state according to exemplary embodiments of the present invention.

FIGS. 5A and 5B are diagrams illustrating the feed system 300 or 400 in a partially collapsed state according to an exemplary embodiment of the present invention. FIG. 5C is a diagram illustrating the feed system 300 or 400 in an extended state (e.g., as deployed in space) according to an exemplary embodiment of the present invention.

Since both the feed system 300 and the feed system 400 are lightweight and flexible, either can collapse to occupy a small volume during launch. For example, the feed system 300 or the feed system 400 can be folded and stowed for launch and then extended, for example as the spherical balloon 140 is inflated as shown in FIGS. 5A through 5C.

Figure 6:
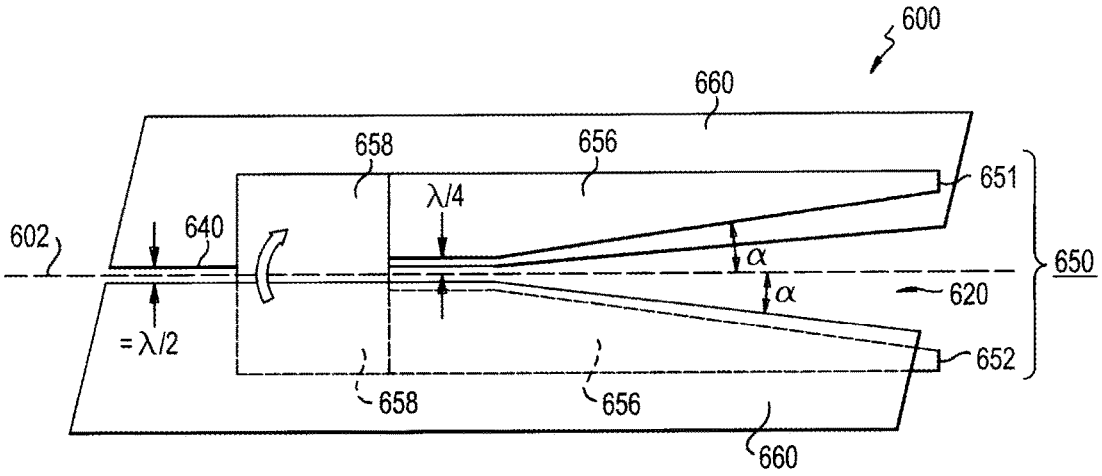
FIG. 6 is a side view illustrating a circularly polarized line feed according to an exemplary embodiment of the present invention.

FIG. 6 is a side view illustrating a circularly polarized line feed 600 according to an exemplary embodiment of the present invention.

Like the feed system 300, which is linearly polarized, the circularly polarized line feed 600 includes planar antenna structure 620 and a slot transmission line 640 formed on a metallic layer 660 (deposited on a dielectric support curtain 146, which is not shown). The circularly polarized line feed 600 also includes an orthogonal antenna structure 650, oriented substantially orthogonal to the first antenna structure 620 along the same center line 602 as the planar antenna structure 620. The orthogonal antenna structure 650 includes a top member 651 and a bottom member 652, which is substantially identical to the top member 651. The top member 651 and the bottom member 652 may include a metalized film 656 deposited on a dielectric film 658.

As shown in FIG. 6, the slot transmission line 640 may have a width of $\lambda/2$ and the feed point/apex of the orthogonal antenna structure 650 may be offset from the center line 602 by a distance of $\lambda/4$.

Figure 7:
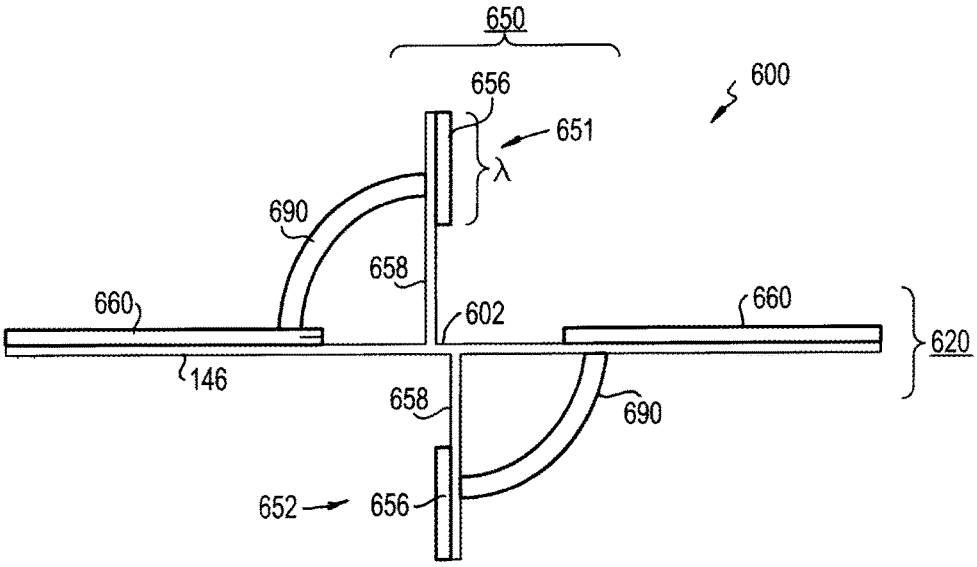
FIG. 7 is a front view illustrating the circularly polarized line feed of FIG. 6 according to an exemplary embodiment of the present invention.

FIG. 7 is a front view illustrating the circularly polarized line feed 600 according to an exemplary embodiment of the present invention.

As shown in FIG. 7, the planar antenna structure 620 is formed by depositing the metallic layer 660 on the dielectric support curtain 146 and the orthogonal antenna structure 650 is formed by depositing the metalized film 656 on dielectric film 658. The circularly polarized line feed 600 may include hinges 690 which may cause the orthogonal antenna structure 650 to "pop up" so that the orthogonal antenna structure 650 is substantially orthogonal to the planar antenna structure 620.

When stowing the circularly polarized line feed 600 for launch, the hinges 690 may release so that the top member 651 rests on top of the planar antenna structure 620 and the bottom member 652 may rest on the bottom of the dielectric support curtain 146. Accordingly, the circularly polarized line feed 600 may collapse as shown in FIGS. 5A-5B and expand as shown in FIG. 5C and described above with reference to the feed structures 300 and 400.

The circularly polarized line feed 600 is used to transmit circularly polarized signals that are reflected off the reflective surface 144 or receive signals that have been reflected off the reflective surface 144. The signals may have either right hand circular polarization (RCP) or left hand circular polarization (LCP). The slot transmission line 640 transmits signals between the circularly polarized line feed 600 and the RF module 184 (not shown), for example via a coaxial cable. For example, the center of the coaxial cable may feed one side of the slot transmission line 640 and the shield of the coaxial cable may feed the other side of the slot transmission line 640. The sense of the circular polarization (RCP or LCP) can be selected, for example, by exchanging the parts of the coaxial cable (center and shield) feeding each side of the slot transmission line 640.

Figure 8:
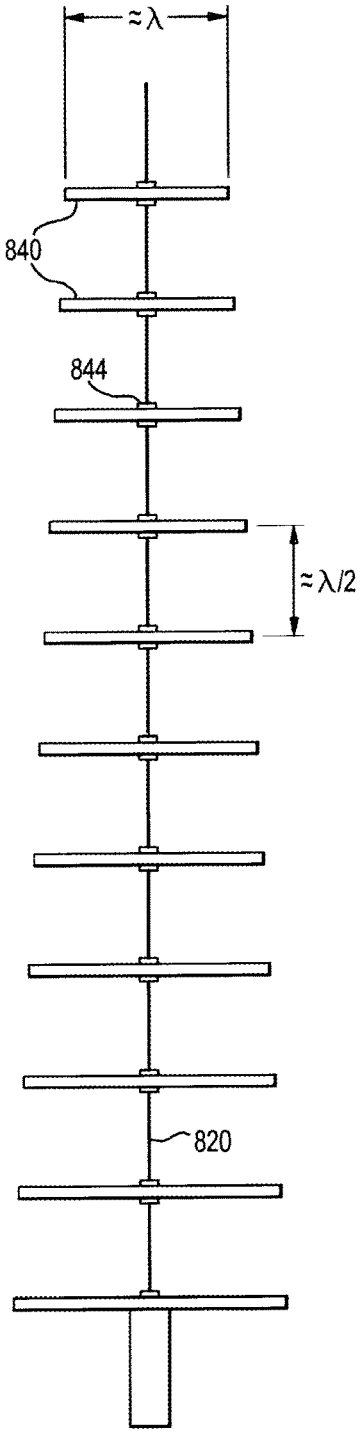
FIG. 8 is a diagram illustrating a collapsible line feed according to an exemplary embodiment of the present invention.

FIG. 8 is a diagram illustrating a collapsible line feed 800 according to an exemplary embodiment of the present invention.

As shown in FIG. 8, the collapsible line feed 800 includes a monopole 820 and a plurality of metallic discs 840 along the monopole 820. The metallic discs 840 may have a diameter$\approx\lambda$ and may be separated by a distance$\approx\lambda/2$. The diameter of each disk may be varied to provide the desired illumination pattern on the spherical reflector. Each metallic disc 840 may include a coaxial insulator 844 to allow the monopole 820 to pass through. To make the line feed 800 collapsible, the monopole 820 may be a thin wire. Additionally, the metallic discs 840 may be a flexible dielectric material covered with a $\geq 3\delta$ metal coating.

Figure 9A:
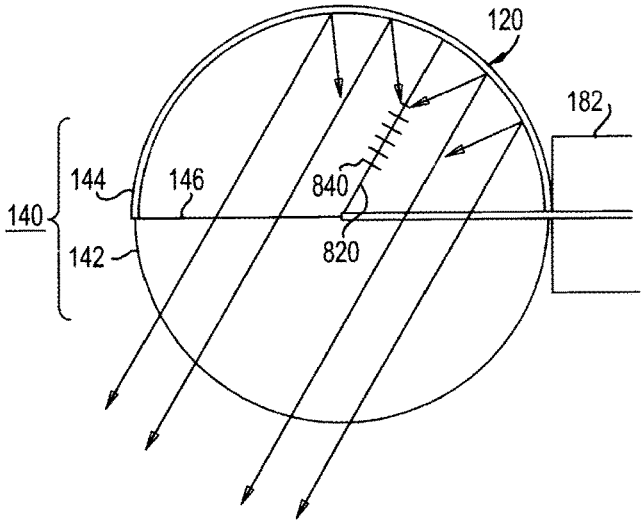
FIG. 9A is a diagram illustrating the collapsible line feed of FIG. 8 in an extended state according to an exemplary embodiment of the present invention.

FIG. 9A is a diagram illustrating the collapsible line feed 800 in an extended state (e.g., as deployed in space) according to an exemplary embodiment of the present invention.

While Vee antennas (like the feed systems 300, 400, and 600) work with spherical reflectors by illuminating them on size scales over which they approximate parabolas, line feeds such as the collapsible line feed 800 utilize more of the spherical reflector. As shown in FIG. 9A, the monopole 820 may be arranged along a radius of the spherical balloon 140. Accordingly, when the balloon reflector antenna 120 receives a signal (e.g., from the ground), the signal passes through the transparent surface 142 and encounters the reflective surface 144, which focuses the signal into line feed 800. When the balloon reflector antenna 120 transmits a signal (e.g., to the ground), the signal is emitted by the line feed 800 and encounters the reflective surface 144, which directs the signal through the transparent surface 142. A coaxial cable 902 may transmit signals between the antenna structure 320 and the RF module 184 (not shown).

Two or more collapsible line feeds 800 may be used in concert in the same spherical balloon 140, for example to provide a phased array line feed as described in PCT Pat. Appl. No. PCT/US16/42462.

Figure 9B:
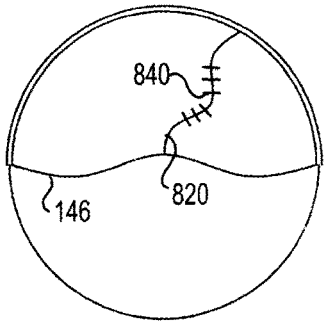
FIG. 9B is a diagram illustrating the collapsible line feed of FIG. 8 in partially collapsed state according to exemplary embodiments of the present invention.
Figure 9C:
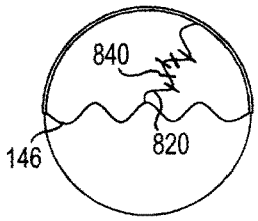
FIG. 9C is a diagram illustrating the collapsible line feed of FIG. 8 in another partially collapsed state according to an exemplary embodiment of the present invention.

FIGS. 9B and 9C are diagrams illustrating the collapsible line feed 800 in partially collapsed states (e.g., as the balloon reflector antenna 120 is deflated) according to exemplary embodiments of the present invention.

As shown in FIGS. 9B and 9C, because the monopole 820 is flexible, the collapsible line feed 800 can collapse vertically and can be stowed for launch, for example in the balloon reflector canister 182. Then, when the satellite 100 is deployed and the balloon reflector antenna 120 is inflated, the spherical balloon 140 pulls the collapsible line feed 800 into the extended position as shown in FIG. 9A.

Aspects of the feed system 300, the feed system 400, the feed system 600 and/or the line feed 800 may be used in terrestrial and/or space-based applications in conjunction with reflector antennas such as spherical reflector antennas, parabolic antennas, Gregorian antennas, etc.

The foregoing description and drawings should be considered as illustrative only of the principles of the inventive concept. Exemplary embodiments may be realized in a variety of shapes and sizes and are not intended to be limited by the preferred embodiments described above. Numerous applications of exemplary embodiments will readily occur to those skilled in the art. Therefore, it is not desired to limit the inventive concept to the specific examples disclosed or the exact construction and operation shown and described. Rather, all suitable modifications and equivalents may be resorted to, falling within the scope of this application.

The invention claimed is:

1. A collapsible line feed for a reflector antenna, the line feed comprising:

a plurality of metallic disks; and a flexible monopole passing through the plurality of metallic disks, wherein the line feed is flexible such that the metallic discs may be stacked for deployment and the flexible monopole may be extended when deployed.

2. The line feed of claim 1, where the metallic disks comprise a flexible dielectric material with a metal coating.

3. The line feed of claim 1, wherein the flexible monopole is a wire.

4. The line feed of claim 1, wherein the line feed is for a spherical reflector antenna.

5. The line feed of claim 4, wherein the spherical reflector antenna is a balloon reflector antenna.

6. The line feed of claim 5, wherein the flexible monopole extends from a center of the balloon reflector antenna toward a surface of the balloon reflector antenna.

7. A method of deploying a reflector antenna, the method comprising:

providing a collapsible line feed for a reflector antenna, the line feed comprising a plurality of metallic disks and a flexible monopole passing through the plurality of metallic disks;

stacking the plurality metallic disks;

deploying the reflector antenna; and extending the flexible monopole.

8. The method of claim 7, where the metallic disks comprise a flexible dielectric material with a metal coating.

9. The method of claim 7, wherein the flexible monopole is a wire.

10. The method of claim 7, wherein the reflector antenna is a spherical reflector antenna.

11. The method of claim 10, wherein the spherical reflector antenna is a balloon reflector antenna.

12. The method of claim 11, wherein the flexible monopole extends from a center of the balloon reflector antenna toward a surface of the balloon reflector antenna.

* * * * *